US009010242B2

(12) United States Patent
Zeinhofer

(10) Patent No.: US 9,010,242 B2
(45) Date of Patent: Apr. 21, 2015

(54) METHOD AND DEVICE FOR CONTROLLING THE REGISTER SETTINGS OF A PRINTING PRESS

(75) Inventor: Joseph Zeinhofer, Maulburg (DE)

(73) Assignee: Mueller Martini Holding AG, Hergiswil (CH)

( * ) Notice: Subject to any disclaimer, the term of this patent is extended or adjusted under 35 U.S.C. 154(b) by 523 days.

(21) Appl. No.: 13/151,855

(22) Filed: Jun. 2, 2011

(65) Prior Publication Data

US 2011/0297026 A1 Dec. 8, 2011

(30) Foreign Application Priority Data

Jun. 2, 2010 (CH) ..... 875/10

(51) Int. Cl.

| | |
|---|---|
| ***B41F 1/34*** | (2006.01) |
| ***B41F 3/44*** | (2006.01) |
| ***B41F 33/00*** | (2006.01) |
| ***B41F 13/02*** | (2006.01) |

(52) U.S. Cl.

CPC ..... *B41F 33/0081* (2013.01); *B41F 13/025* (2013.01); *B41P 2213/734* (2013.01); *B41P 2213/90* (2013.01)

USPC ..... 101/481; 101/485; 101/211; 101/179

(58) Field of Classification Search

USPC ..... 101/481, 485, 486, 179, 211, 181, 484

See application file for complete search history.

(56) References Cited

U.S. PATENT DOCUMENTS

| | | | | |
|---|---|---|---|---|
| 5,127,324 | A * | 7/1992 | Palmatier et al. | 101/248 |
| 5,806,430 | A * | 9/1998 | Rodi | 101/484 |
| 6,499,397 | B2 * | 12/2002 | Stern | 101/248 |
| 2002/0029706 | A1 | 3/2002 | Dauer | |
| 2007/0051265 | A1 | 3/2007 | Schultze | |
| 2009/0020029 | A1 * | 1/2009 | Reckefuss | 101/248 |

FOREIGN PATENT DOCUMENTS

| | | | |
|---|---|---|---|
| DE | 10254836 | A1 | 6/2004 |
| DE | 10 2006 060212 | A1 | 7/2008 |

(Continued)

OTHER PUBLICATIONS

International Search Report issued in CH 8752010 dated Jul. 8, 2010.

(Continued)

*Primary Examiner* — Matthew G Marini

(74) *Attorney, Agent, or Firm* — Venable LLP; Robert Kinberg; Tamatane J. Aga

(57) ABSTRACT

A method for controlling register settings of a printing press, includes rotating imaging cylinders of a first print unit and a second print unit, located downstream of the first print unit in a movement direction of a print medium, at a rotational speed to print an image on the print medium. The method includes of changing a length of the print image to a pre-determined length. The method further includes changing a register setting of the imaging cylinder of the second print unit based on the predetermined change in length of the print image to avoid misalignment of the print image printed by the first and the second print units on the print medium. Changing the register setting is dependent on a length of a section of the print medium between the first and the second print units. A device for controlling register settings of a printing press is also disclosed.

20 Claims, 2 Drawing Sheets

(56) References Cited

FOREIGN PATENT DOCUMENTS

| | | | |
|---|---|---|---|
| DE | 10 2007 024323 | A1 | 11/2008 |
| EP | 0 882 588 | A1 | 12/1998 |
| EP | 1 593 502 | A1 | 11/2005 |
| JP | 62-112002 | A | 5/1987 |
| JP | 62-124950 | A | 6/1987 |
| JP | 62-227747 | A | 10/1987 |
| JP | 63-295290 | A | 12/1988 |
| JP | 64-082954 | A | 3/1989 |
| JP | 01-110151 | A | 4/1989 |
| JP | 06-000951 | A | 1/1994 |
| JP | 07-117217 | A | 5/1995 |
| JP | 11-268250 | A | 10/1999 |
| JP | 2000-309087 | A | 11/2000 |
| JP | 2002-113844 | A | 4/2002 |
| JP | 2005-119157 | A | 5/2005 |
| JP | 2006-321213 | A | 11/2006 |
| JP | 2007-069607 | A | 3/2007 |

OTHER PUBLICATIONS

Office Action issued in Japanese Patent Application No. 2011-123350 dated Feb. 18, 2015.

* cited by examiner

METHOD AND DEVICE FOR CONTROLLING THE REGISTER SETTINGS OF A PRINTING PRESS

CROSS-REFERENCE TO RELATED APPLICATION

This application claims the priority of the Swiss Patent Application No. 00875/10, filed on Jun. 2, 2010, the subject matter of which is incorporated herein by reference.

BACKGROUND OF THE INVENTION

The invention relates to a method and device for controlling register settings of a printing press, as well as to a printing press provided with such a device.

For multi-color printing, at least two color components are printed over each other in a printing press with the aid of a plurality of imaging cylinders. If a printing press is in register or, differently expressed, is in an overlapping fit, the images printed by the different print units, which respectively print on a single color component, are placed to fit precisely one above the other.

In web-fed presses, a print medium or substrate, for example, paper or film, frequently travels long distances between two print units. Devices are integrated into these web-fed presses which make it possible to precisely adjust the register settings and to continuously re-adjust the register settings during the course of the printing operation. Such devices are also used in sheet-fed printing presses.

Markings such as the so-called registration marks or registration crosses are auxiliary means used for known register settings. These markings are also printed on outside of the picture area by each printing press. With the aid of image-processing systems, the positions of the respectively relevant registration marks, relative to each other, are recorded as well as evaluated and the printing press is readjusted accordingly.

To evaluate the register or the register accuracy, a distinction is made between the lineal register (in the movement direction of the web of print medium), the side or lateral register (transverse to the movement direction) and the diagonal register. The problem defined for the invention essentially relates to the lineal register.

For example, deviations detected in the lineal register can be compensated for by displacing individual guide rollers, meaning the register rollers, which shorten or lengthen the distance between two print units. Alternatively, the lineal register can also be adjusted by rotating the imaging cylinders relative to each other.

A deviation in the register is normally caused by the use of a different type of print medium which exhibits a different expansion behavior as compared to the previously used print medium. The speed of the printing press can also require a readjustment of the register because the print medium web behaves differently, depending on the speed of the printing press.

Controls for register settings of this type are disclosed, for example, in the German patent documents DE 102006060212 A1 or DE 10254836 A1.

Known register settings take into account, insufficiently or not, that the length of the print medium web section between the print units that take part in the printing operation can vary noticeably as a result of changes in the configuration of the printing press. The deviations in the register can consequently exceed those normally occurring in the detection range for standard register settings, thus making it impossible for the register to be adapted automatically. Also not addressed as a subject is the influencing of the register as a result of a change specified by the machine operator in the length of the intended print image. With known printing presses, this is realized by specifying a heterodyne speed for the individual drives of the imaging cylinders belonging to adjacent print units, which participate in the image-printing process.

The length of the print image can be shortened by approximately up to 1 mm, relative to the original format of the print image, wherein this can be achieved through accelerating the drive of the imaging cylinder. Owing to the higher but constant rotational speed, as compared to the theoretically correct speed for the print medium, the print image is correspondingly shortened.

In contrast, the print image is lengthened by approximately up to 3 mm, relative to the original format for the print image, if the speed of the respective imaging cylinder drive is slowed as compared to the speed of the print medium web. Thus, the print image can be pulled over a longer section of the web than is provided based on a corresponding negative on the imaging cylinder.

Register deviations caused by changes in the length of the print image as a rule do not fall within the detection range of the above-discussed register settings. For example, if five print images and/or formats, which must respectively be lengthened, are located between two adjacent print units, the change in the length of each print image on the whole results in a register deviation in the downstream arranged print unit, as seen in production direction, in the order of magnitude of five times the change in length for the print image.

With printing presses that are especially flexible for use, the length of the print medium section between two adjacent print units frequently varies considerably as a result of production changes, so that it is not automatically certain just how many print images are located between two adjacent print units.

SUMMARY

It is an object of the present invention to provide a method and a device which make use of a control unit to correct register deviations located outside of the normal detection range of known register settings. For this, essential influencing factors must be determined and these must be supplied to the printing press in the form of control variables.

The above and other objects are accomplished according to one aspect of the invention wherein there is provided a method for controlling register settings of a printing press, which, in one embodiment, includes rotating imaging cylinders of a first print unit and a second print unit, located downstream of the first print unit in a movement direction of a print medium, at a rotational speed to print an image on the print medium; changing a length of the print image to a predetermined length; changing a register setting of the imaging cylinder of the second print unit based on the predetermined change in length of the print image to avoid misalignment of the print image printed by the first and the second print units on the print medium, where the changing of the register setting is dependent on a length of a section of the print medium between the first and the second print units.

The application furthermore relates to a device for controlling register settings of a printing press, which, according to one embodiment includes a first print unit and a second print unit, located downstream of the first print unit in a movement direction of the print medium, which each respectively include an imaging cylinder rotating with a rotational speed for printing images on the print medium, where the imaging cylinder of the second print unit includes register settings that are changeable to avoid misalignment of the images printed on the print medium by the first and second print units; a control unit adapted to determine a length of a section of the print medium between the first and second print units; a sensor coupled to each of the first and second print units, where each sensor is adapted to detect a marking on the print medium, generate a corresponding signal, and transmit the signal to the control unit; and a drive system that is adapted to change the register settings of the imaging cylinder of the second print unit based on the length of the section of the print medium.

According to one embodiment, the method for the register control may be used in a printing press provided with a first print unit and at least one additional print unit. The print units may be respectively provided with at least one imaging cylinder operating with a rotational speed. To avoid a running of the images printed on by a plurality print units, the register settings of the at least one imaging cylinder of the additional print units may be changed, to correspond to a specified change in the length of a print image.

According to one embodiment, the register settings may be changed in dependence on at least the length of a print medium section between the print units.

As a result of this method, it may be possible to save waste paper and set-up time because the register control may automatically carry out a correction. An intervention by the machine operator may therefore not be required, meaning that the process is more secure.

According to one embodiment of the method, the register settings may be changed while the printing press is operational. A predetermined change in the length of a print image may be realized by changing the rotational speed of the at least one imaging cylinder of the additional print units, relative to the speed of the print medium web. The theoretically correct rotational speed of the at least one imaging cylinder thus may be relative to the rotational speed assigned to the changed length of the print image, wherein this ratio may generally exit between the rotational speed of a rubber-blanket cylinder and the speed of a counter-pressure cylinder.

The change in the register settings of the at least one imaging cylinder of the additional print units may be corrected according to a different embodiment by correcting the length of the print medium section between the print units, relative to a reference position in the printing press. According to one embodiment, this reference position may be defined by the first print unit which participates in the printing process, as seen in web movement direction.

According to another embodiment, the correction value may be formed by multiplying the change in length of the print image with the number of print images located between the respectively adjacent print units. The number of print images may be determined by dividing the length of the print medium section between the respectively adjacent print units by the length of one print image, as seen in movement direction of the print medium.

The length of the print medium section between the respectively adjacent print units may be determined by evaluating at least one signal from at least two sensors. The sensors of favorable embodiments may emit a signal once they have identified a marking on the print medium.

The marking may be affixed to the print medium with the aid of a marking device, either upstream of the first print unit or in the print unit, in particular through stamping, punching, applying color or gluing it on.

Light barriers may be used for the sensors.

The length of the print medium section between the respectively adjacent print units may be determined with the aid of expedient methods and an accuracy of less than 0.2 mm.

Pulse transmitters provided in print unit drive systems, in particular in servo-drive systems, may be used to additionally evaluate the angular position of the print units. A signal may be generated on the basis of the determined angular position for the print units and may then be evaluated together with the signals relating to the length of the print medium section between respectively adjacent print units, wherein the register settings of the at least one imaging cylinder of the additional print units may be changed in accordance with the evaluation that is carried out.

According to the invention, a device for controlling the register of a printing press may be designated for use in a printing press. The printing press may comprise a first print unit and at least one additional print unit. Each print unit may be provided with at least one imaging cylinder that may move with a rotational speed. The register settings of the additional print units which follow the first print unit may be changed to avoid a running of images which may be printed one over the other by a plurality of print units.

The device for the register control may include a control unit and respectively at least one drive system and at least one sensor for the print units, wherein the drive system in particular is a servo-drive system. The at least one sensor may detect a marking on the print medium, may generate a corresponding signal, and may transmit this signal to the control unit. The length of a print medium section between the print units may be determined with the aid of the signals received from the at least one sensor. Depending on the length that is determined, the register settings for the additional print units may be changed with the drive systems.

According to one embodiment of the device, the at least one sensor may be respectively arranged either on the print units or behind the print units, as seen in movement direction of the print medium.

The device according to a different embodiment may be provided with a marking device which may be arranged in the movement direction of the print medium either upstream of or in a first print unit. With the aid of the marking device, a marking may advantageously be affixed to the print medium, either upstream of or in the first print unit, or may be incorporated therein, in particular through stamping, punching, applying color or gluing.

According to a different embodiment, the device may be provided with at least one pulse transmitter, in particular arranged on the drive system, for detecting the angular position of at least one of the print units and to transmit this position to the control unit as well as to the drive system.

It may be particularly expedient if a printing press is equipped with one of these devices.

BRIEF DESCRIPTION OF THE DRAWINGS

The present invention will be more readily understood from the following detailed description when read in conjunction with the accompanying drawings, in which.

DETAILED DESCRIPTION

Figure 1:
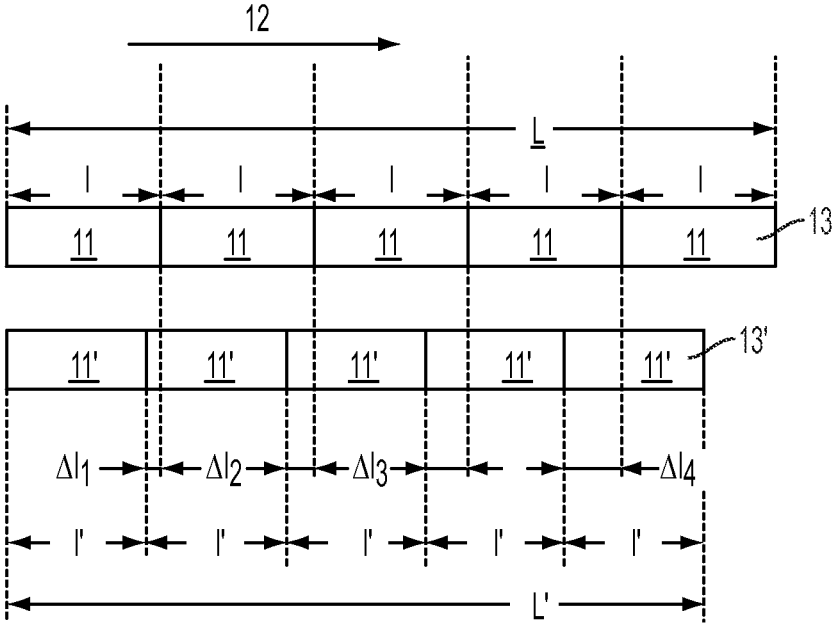
FIG. 1 is a view from above of two parallel-arranged print medium webs, showing their respective division into print images, according to an embodiment of the present invention.
Figure 2:
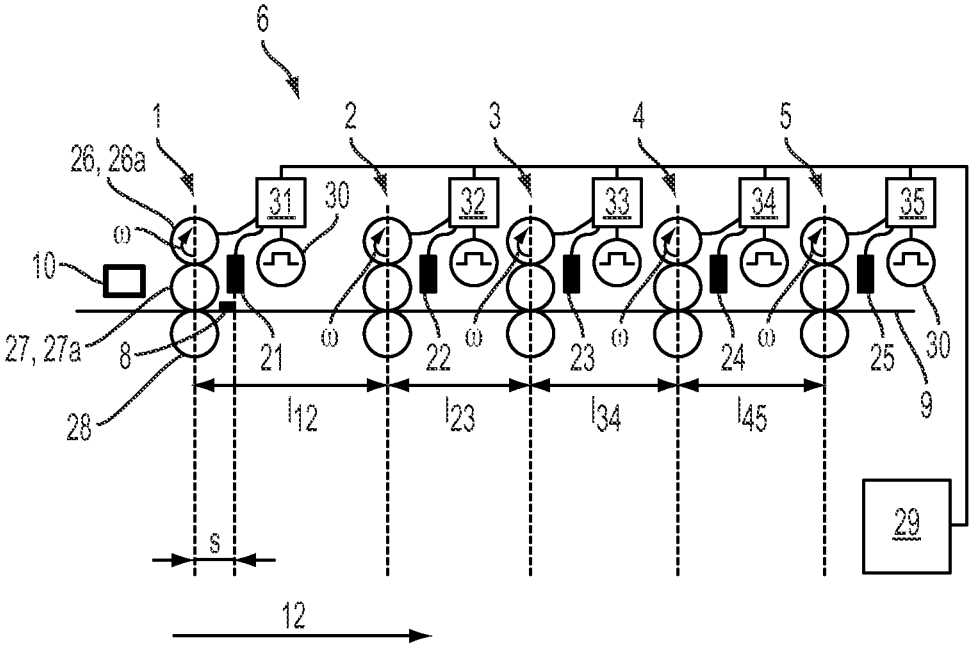
FIG. 2 is a schematic representation of a radial section through a printing press equipped with five print units comprising separately driven imaging cylinders, wherein a print medium web is guided through the printing press, according to an embodiment of the present invention.

FIG. 2 schematically illustrates a printing press 6 with five print units 1, 2, 3, 4, 5, namely a first print unit 1 and four additional print units 2, 3, 4, 5. A print medium 9 web is guided in the movement direction 12 through the printing press 6 and, in the process, passes the print units 1, 2, 3, 4, 5 one after another. Two webs 13, 13' of print medium 9 are shown in FIG. 1 in a view from above, to clearly illustrate the division of these webs into sections representing the print images 11, 11'. Each of the print units 1, 2, 3, 4, 5 with imaging cylinders 26, 27, which are also called format cylinders, is used to print one color component of the multi-color print image 11, 11' onto the print medium 9. The complete multi-color print image 11, 11' is generated at the downstream end of the printing press 6 through printing of the individual color components, one over the other, with the print units 1, 2, 3, 4, 5.

According to FIG. 2, the print units 1, 2, 3, 4, 5 are provided with respectively two imaging cylinders 26, 27, arranged vertically one above the other, namely a plate cylinder 26*a* on the top and a rubber-blanket cylinder 27*a* on the bottom, below which in turn a counter-pressure cylinder 28 is positioned. The print medium 9 is transported in movement direction 12 between the rubber-blanket cylinder 27*a* and the counter-pressure cylinder 28. The print image 11, 11' is initially created above the print medium 9 in that the plate cylinder 26*a* rolls off the rubber-blanket cylinder 27*a*. These imaging cylinders 26, 27 rotate with the same rotational speed and are operated synchronized with the speed of the print medium 9, or are operated at a faster and/or slower speed than the sprint medium speed, depending on the desired length of the print image 11, 11'. Finally, the rubber-blanket cylinder 27*a* rolls off the print medium 9, thereby transferring the print image 11, 11' to the latter. If the plate cylinder 26*a* and the rubber-blanket cylinder 27*a* rotate with a constant, but slightly lower speed than that of the web 13, 13' of print medium 9, then a slightly longer print image is created. The speed of the counter-pressure cylinder on the other side of the web 13, 13' of print medium 9 remains unchanged in that case.

This speed variation is valid to the same degree and/or the same speed difference for all print units 1, 2, 3, 4, 5. Each print unit 1, 2, 3, 4, 5 can be driven with an individual rotational speed w, either directly with a separate drive system 31, 32, 33, 34, 35 or indirectly via drive rollers that are not shown herein.

As seen in movement direction 12 of the print medium 9, a marking device 10 is provided upstream of a first print unit 1. Alternatively, the marking device 10 can also be arranged inside the first print unit 1.

During the start-up of the printing press 6 or for a change in the configuration, for example a change in the web guidance between the print units 1, 2, 3, 4, 5, the marking device 10 affixes a marking 8 to the print medium 9. The length of the section of print medium 9 between the print units 1, 2, 3, 4, 5, must therefore be determined only once and need not be repeated until the actual length of the print medium 9 section between the print units 1, 2, 3, 4, 5 is changed.

As seen in movement direction 12 of the print medium 9, a separate sensor 21, 22, 23, 24, 25 is arranged behind each print units 1, 2, 3, 4, 5, for example a sensor in the form of a light barrier. The sensors 21, 22, 23, 24, 25 generate a signal as soon as the marking 8 reaches their position and subsequently transmit this signal to a control unit 29 which is connected to the drive systems 31, 32, 33, 34, 35 for the print units 1, 2, 3, 4, 5. A distance s between a print unit 1, 2, 3, 4, 5 and the respectively following sensor 21, 22, 23, 24, 25 is known. A section of the print medium 9 with a defined length is located within this distance s.

Of course, the sensors 21, 22, 23, 24, 25 can also be arranged in the respective print unit 1, 2, 3, 4, 5 and can furthermore be used to detect tears in the print medium 9 web. The control unit for the printing press can additionally function as the control unit 29.

A section of the web 13, 13' of print medium 9 with a first length $l_{12}$ is located between the first print unit 1 and the second print unit 2. A second section with length $l_{23}$, a third section with length $l_{34}$ and a fourth section with length $l_{45}$ of the web 13, 13' of print medium 9 are accordingly assigned to the intermediate spaces following in movement direction 12 between the print units 2, 3, 4, 5. In particular with production changes, these sections with lengths $l_{12}$, $l_{23}$, $l_{34}$, $l_{45}$ of the web 13, 13' of print medium 9 can vary.

A printing press 6 of this type can detect the respective length $l_{12}$, $l_{23}$, $l_{34}$, $l_{45}$ of the web 13, 13' sections of print medium 9 between the print units 1, 2, 3, 4, 5 with the aid of the sensors 21, 22, 23, 24, 25 and the control unit 29, in particular also during changes in the machine operation.

Figure 3:
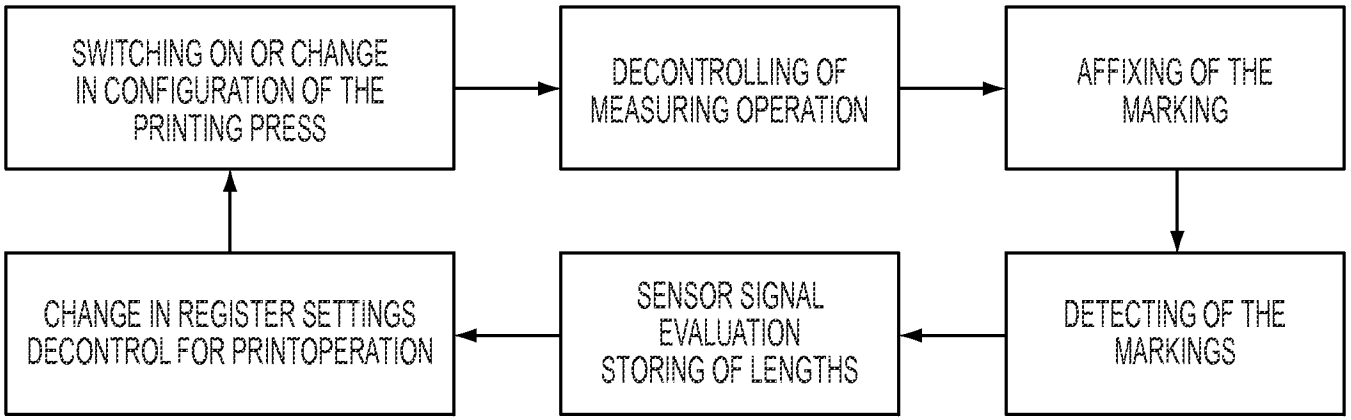
FIG. 3 is a first block diagram, designed to illustrate the process sequence for determining the geometric lengths between the print units according to an embodiment of the present invention.

Upon switching on of the printing press, or after it has been reconfigured by changing the length of the web 13, 13' section of print medium 9 between two print units 1, 2, 3, 4, 5, a command is first issued to enable the measuring operation, meaning for detecting the new length of the web 13, 13' section of print medium 9 between the print units 1, 2, 3, 4, 5. According to the sequence shown in FIG. 3, the marking 8 is then applied to the print medium 9. Of course, the marking 8 can also be incorporated into the print medium 9. The control unit 29 subsequently evaluates the signals detected by the respective sensor 21, 22, 23, 24, 25 as a result of the marking 8 which moves past the respective sensor 21, 22, 23, 24, 25. The control unit knows the distance s between the print unit 1, 2, 3, 4, 5 and the respectively following sensor 21, 22, 23, 24, 25 but not necessarily also the distance between the first print unit 1 and the marking device 10. Based on the signals transmitted by the sensors 21, 22, 23, 24, 25 and the known distances s, the up-to-date lengths $l_{12}$, $l_{23}$, $l_{34}$, $l_{45}$ for the print medium 9 sections between the print units 1, 2, 3, 4, 5 are determined by the control unit 29 and are secured, meaning stored. In addition, the control unit 29 generates a signal for changing the register settings in the additional print units 2, 3, 4, 5 and transmits this signal to the respective drive systems 32, 33, 34, 35. A measuring operation carried out with the first and the second sensor 21, 22, followed by the evaluation of the signals based on the measuring results and transmitted to the control unit 29, results in at least a corresponding influencing of the register settings of the second print unit 2 and is furthermore used to enable the printing operation. The control unit 29 and the drive systems 31, 32, 33, 34, 35 then await the next switching on or the next change in the configuration of the printing press 6.

For a comparison, FIG. 1 shows two webs 13, 13' of print medium 9 which are laid out parallel to each other. The first web 13 has a total length L. Five identical print images 11 with a length l are positioned on this web 13. The second web 13' of print medium 9 differs from the first web 13 of print medium 9 by a change in the length of the print images 11, 11'. For the example shown in FIG. 1, the resulting total length L' for the five illustrated print images 11' of the second web 13', which respectively have a length l', is on the whole noticeably shorter than the length of the first web 13.

FIG. 1 therefore shows a change in the length $\Delta l_1$, specified by the machine operator, for the print images 11, 11' as a difference in the length l of the print images 11, relative to the length l' of the print images 11'. It is clear that after the fifth print image 11, 11', a four-fold change in the length $\Delta l_4$ of the web 13' is reached on the whole as compared to the web 13, or vice versa, when this change in length is made for each of the five print images 11, 11' positioned in-between respectively two print units 1, 2, 3, 4, 5.

Figure 4:
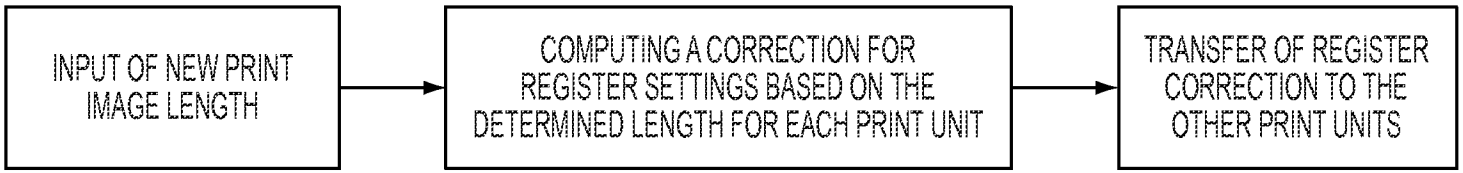
FIG. 4 is a second block diagram, designed to illustrate the process steps for realizing the register correction, according to an embodiment of the present invention.

FIG. 4 illustrates the sequence of steps to be carried out for making a correction to the register in dependence on the length of the print image. If the respective length $l_{12}$, $l_{23}$, $l_{34}$, $l_{45}$ between the print units 1, 2, 3, 4, 5 has been determined according to the inventive method and the length of the print images 11, 11' is known, the control unit 29 already knows how many print images 11, 11' are located between two print units 1, 2, 3, 4, 5. Based on the number of print images 11, 11' between two adjacent print units 1, 2, 3, 4, 5, a correction for the register settings is computed with the aid of an operator-specified length change $\Delta l_1$ for the print image 11, 11'. This correction value is then sent from the control unit 29 to the additional print units 2, 3, 4, 5 to be adjusted and/or to the associated drive systems 32, 33, 34, 35. In this way, the printing press 6, which is in register prior to the change of the print image length, continues to be in register.

According to FIG. 2, the print units 1, 2, 3, 4, 5 are each provided with a pulse transmitter 30 that is arranged on the drive system 31, 32, 33, 34, 35. The angular position of at least one of the print units 1, 2, 3, 4, 5 can thus be detected with the pulse transmitter 30 and can be transmitted to the drive system 31, 32, 33, 34, 35 as well as to the control unit 29. On the basis of the determined angular position, a signal is generated which is evaluated in the control unit 29, together with the signals relating to the length $l_{12}$, $l_{23}$, $l_{34}$, $l_{45}$ of the print medium 9 between the respectively adjacent print units 1, 2, 3, 4, 5, wherein the register settings of the at least one imaging cylinder 26, 27 of the additional print units 2, 3, 4, 5 are changed in accordance with the completed evaluation.

It will be understood that the above description of the present invention is susceptible to various modifications, changes and adaptations, and the same are intended to be comprehended within the meaning and range of equivalents of the appended claims.

What is claimed is:

1. A method for controlling register settings of a printing press, comprising the steps of:

rotating imaging cylinders of a first print unit and a second print unit, located downstream of the first print unit in a movement direction of a print medium, at a rotational speed to print an image on the print medium;

changing a length of the print image to a predetermined length; and changing a register setting of the imaging cylinder of the second print unit based on the predetermined change in length of the print image to avoid misalignment of the print image printed by the first and the second print units on the print medium, wherein the changing of the register setting is dependent on a length of a section of the print medium between the first and the second print units, wherein changing the register settings of the imaging cylinder of the second print unit includes the steps of:

determining a number of print images between the first and second print units by dividing the length of the section of the print medium between the first and second print units by the length of one print image, as seen in the movement direction of the print medium; and multiplying the change in the length of the print image by the number of print images between the first and second print units.

2. The method according to claim 1, wherein changing the register setting occurs during operation of the printing press, and wherein changing the length of the print image includes changing the rotational speed of the imaging cylinder of the second print unit, as compared to a speed of the print medium.

3. The method according to claim 1, further comprising correcting the register settings of the imaging cylinder of the second print unit, and correcting a length of the section of the print medium relative to a reference position in the printing press.

4. The method according to claim 3, wherein the reference position comprises a position defined by the first print unit participating in the printing operation, as seen in the movement direction of the print medium.

5. The method according to claim 1, further comprising determining the length of the section of the print medium between the first and second print units by evaluating at least one signal from at least two sensors.

6. The method according to claim 5, further comprising identifying a marking on the print medium based on the at least one signal emitted by the at least two sensors.

7. The method according to claim 6, further comprising affixing the marking to the print medium with the aid of a marking device, located either upstream of or in the first print unit, through at least one of stamping, punching, applying color or gluing.

8. The method according to claim 5, wherein the at least two sensors comprise light barriers.

9. The method according to claim 5, wherein determining the length of the section of the print medium between the first and second print units is performed with an accuracy of less than 0.2 mm.

10. The method according to claim 5, further comprising:

detecting an angular position of at least one of the first and second print units with the aid of a pulse transmitter which is arranged in a drive system of the at least one of the first and second print units;

generating a signal based on the angular position of the at least one of the first and second print units;

evaluating the signal together with the at least one signal relating to the length of the section of the print medium between the first and second print units; and changing the register settings of the imaging cylinder of the second print unit in accordance with the evaluation results.

11. The method of claim 10, wherein the drive system comprises a servo-drive system.

12. A device for controlling register settings of a printing press, said device comprising:

a first print unit and a second print unit, located downstream of the first print unit in a movement direction of a print medium, which each respectively include an imaging cylinder rotating with a rotational speed for printing images on the print medium, wherein the imaging cylinder of the second print unit includes register settings that are changeable to avoid misalignment of the images printed on the print medium by the first and second print units;

a control unit adapted to determine a length of a section of the print medium between the first and second print units;

a sensor coupled to each of the first and second print units, wherein each sensor is adapted to detect a marking on the print medium, generate a corresponding signal, and transmit the signal to the control unit; and a drive system that is adapted to change the register settings of the imaging cylinder of the second print unit to change a length of the image printed on the print medium based on the length of the section of the print medium;

wherein the control unit further adapted to determine a number of print images between the first and second print units by dividing the length of the section of the print medium between the first and second print units by the length of one print image, as seen in the movement direction of the print medium; and to multiply the change in the length of the print image by the number of print images between the first and second print units.

13. The device according to claim 12, wherein each sensor is respectively arranged on the first and second print units or is respectively arranged downstream of the first and second print units, as seen in the movement direction of the print medium.

14. The device according to claim 12, wherein each sensor comprises a light barrier.

15. The device according to claim 12, further comprising a marking device arranged upstream of the first print unit or in the first print unit, as seen in the movement direction of the print medium.

16. The device according to claim 15, wherein the marking device is adapted to affix a marking to or insert the marking onto the print medium through at least one of stamping, punching, applying color or gluing.

17. The device according to claim 12, further comprising at least one pulse transmitter arranged on the drive system to detect an angular position of at least one of the first and second print units, and to transmit the angular position to the control unit and drive system.

18. The device according to claim 12, wherein the drive system comprises a servo-drive system.

19. A printing press that includes a device as described in claim 12.

20. A method for controlling register settings of a printing press comprising utilizing the device according to claim 12.

* * * * *